US007499015B2

(12) United States Patent
Daum et al.

(10) Patent No.: US 7,499,015 B2
(45) Date of Patent: Mar. 3, 2009

(54) DISPLAY WITH REDUCED "BLOCK DIM" EFFECT

(75) Inventors: Martin Daum, Wolfhausen (CH); Pascal Buchschacher, Spreitenbach (CH)

(73) Assignee: NXP B.V., Eindhoven (NL)

( * ) Notice: Subject to any disclaimer, the term of this patent is extended or adjusted under 35 U.S.C. 154(b) by 566 days.

(21) Appl. No.: 10/535,698

(22) PCT Filed: Nov. 18, 2003

(86) PCT No.: PCT/IB03/05214

§ 371 (c)(1), (2), (4) Date: May 19, 2005

(87) PCT Pub. No.: WO2004/049295

PCT Pub. Date: Jun. 10, 2004

(65) Prior Publication Data

US 2006/0139283 A1 Jun. 29, 2006

(30) Foreign Application Priority Data

Nov. 25, 2002 (EP) ..... 02102642

(51) Int. Cl.
*G09G 3/36* (2006.01)

(52) U.S. Cl. ..... 345/100; 345/98

(58) Field of Classification Search ..... 345/98, 345/100, 211

See application file for complete search history.

(56) References Cited

U.S. PATENT DOCUMENTS

| | | | | |
|---|---|---|---|---|
| 5,506,598 | A * | 4/1996 | Shimada et al. | 345/92 |
| 6,232,944 | B1 | 5/2001 | Okuno et al. | |
| 6,417,829 | B1 * | 7/2002 | Jung et al. | 345/98 |
| 6,531,996 | B1 * | 3/2003 | Murade | 345/98 |
| 7,136,040 | B1 * | 11/2006 | Park et al. | 345/100 |
| 2002/0080133 | A1 * | 6/2002 | Eu | 345/212 |

* cited by examiner

*Primary Examiner*—Chanh Nguyen
*Assistant Examiner*—Calvin C Ma

(57) ABSTRACT

The present invention is directed in general to a LCD-panel, and particularly to a LCD panel whose gate drivers (GD) are assembled without a printed circuit board (PCB). This technique is so called PCB-less, where the wiring of the gate drivers (GD) is not done with conventional printed circuit boards (PCB), but directly on the LCD-glass. The invention is also applicable for chip on glass (COG) technique, where the gate drivers (GD) are directly connected to the glass wiring. To avoid the block-dim effects, while keeping the effort and cost low, it is proposed to add an additional line (VLclean) to each output stage (OUTx), whereby the additional line (VLclean) is used solely for supplying the reference potential of the storage capacitors (Cst) of the selected gate line (GLy). All other (unselected) gate lines are connected to the usual gate off supply line (VL). The VLclean line is routed as a separate track on the LCD-glass and is connected to VL supply at the glass edge or close to the power-supply's output.

7 Claims, 8 Drawing Sheets

DISPLAY WITH REDUCED "BLOCK DIM" EFFECT

Figure 1:
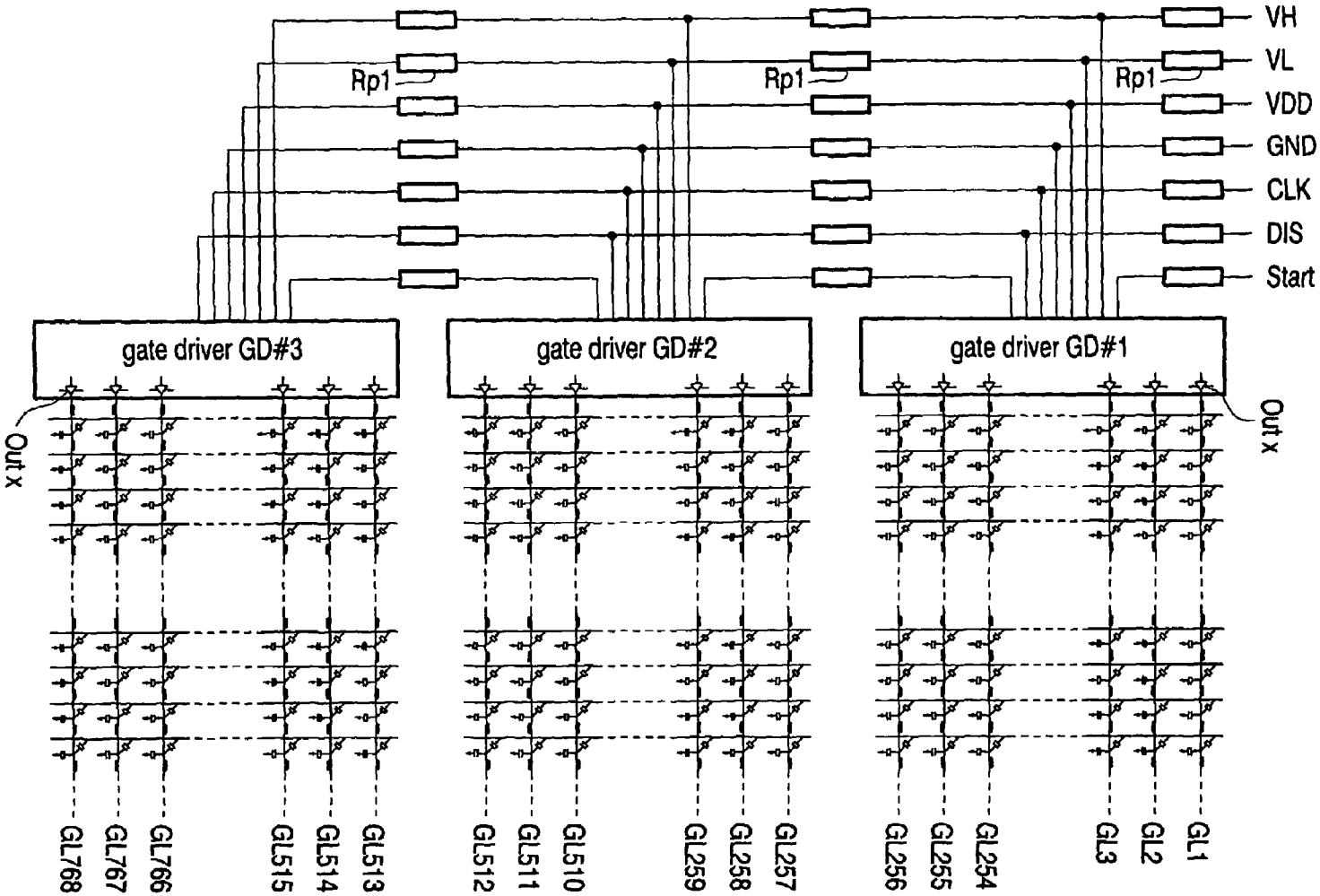

The present invention is directed in general to a display or a LCD-panel, and particularly to a LCD-panel whose gate drivers are assembled without a printed circuit board (PCB). This technique is so called PCB-less, where the wiring of the gate drivers is not done with conventional printed circuit boards (PCB), but directly on the LCD-glass. The invention is also applicable for chip on glass technique (COG).

LCD panels have a wide application area, i.e. for mobile phones, personal digital assistants, notebooks or TV screens.

There are new assembly technologies. Firstly the so called "PCB-less" technique, where the wiring of the gate driver is not done with a conventional printed circuit board (PCB), but directly on the LCD glass and the gate driver chips are mounted on foils (chip-on foil, COF) which are contacted to the glass wires. Secondly the so called chip-on glass technique, where the gate drivers are directly connected to the glass wiring.

These new assembly techniques are low-cost but have the disadvantage that the on-glass wiring track resistance is much higher than the track resistances found on printed circuit boards. The sheet resistance for the on glass interconnection is 100 times higher, than for the PCB-technique. This difference is due to the fact that PCB conductors are thicker and use low-resistivity material, i.e. laminated copper around 35-μm thick, compared to on-glass conductors, which usually use vapour-deposited Al around 0.2-μm thickness. Typical values for the track resistance between two gate drivers are 25Ω for the gate off supply track and up to 100Ω for tracks of other signals. The gate off supply track (VL) supplies the OFF state voltage of the gate lines, it holds the TFT-transistors of the non-addressed lines in the non-conducting (OFF) state.

The increase of track resistances leads to application problems, such as the 'block dim' problem. The block dim problem is mainly caused by the track resistance on gate off supply line(VL). To lower on-glass track resistence, the width of the tracks can be increased, but the space on the LCD-panel available for routing of all tracks is limited. As a consequence, the gate off supply line(VL) track is made as wide as possible, since it is the most critical, and the other tracks are thinner.

A LCD-panel for XGA-resolution typically uses 3 gate drivers with 256 output channels each. On PCB-less or COG-panels all supply lines to the gate drivers and control signals are routed from one LCD-panel corner to the gate drivers on the active plate of the LCD-panel. As a consequence, the track resistance, which is relevant for the third gate driver is about 3 times higher than the track resistance for the first gate driver. In general the number of the gate drivers depends on the size of the LCD-panel.

An active matrix LCD-panel is composed of an array of pixels, whose number is a function of the panel resolution. For example, an XGA panel has 1024 * 768 pixels. A pixel is usually composed of 3 dots, one for every basic colour (Red, Green and Blue). Thus, the XGA-panel example has a total of 1024 * 3 columns on the horizontal axis (x-axis) and 768 rows or lines the vertical axis (y-axis). Each dot is connected to its respective column electrode trough a switch. The switch is addressed (eg switched ON or OFF) by the row electrode. To drive the dots of a selected row, a voltage is applied to the column electrode and the switches are switched ON. This allows all dots of the selected row to charge to the voltage present on the column electrodes. At the end of the addressing time, the switches are switched OFF, which means that the dots are disconnected from the column electrodes and hold their value (charge) until they are selected the next time. This line by line addressing of the individual dots is commonly referred to as the "horizontal scanning" of the display. All the dots of a display are usually refreshed at a frame rate of some 60 Hz. This means that for the XGA panel example, a single line is addressed in (1/60)/768≅20 μsec, which is referred to as the line (addressing) time.

In most active matrix LCD panels, the switch is formed with a so called Thin Film Transistor (TFT). A TFT-transistor has 3 terminals: drain, gate and source. On a TFT-LCD dot, the gate is connected to the row electrode commonly referred to as gate line (GLy). The source is connected to the column electrode commonly referred to as source line (SLx). The drain of the TFT-transistor is connected to the LC capacitance (dot node). The second plate of the dot capacitance is connected to a common counter electrode (Vcom). Due to a considerable charge leakage of the TFT-transistor, there is a need for an additional storage capacitor (Cst) which is connected to the dot node on one side and to a reference node on the other side. Usually, the previous gate line (GLy−1) or the next gate line (GLy+1) is used as reference node because these nodes can easily be accessed. It is also possible to have an extra reference line running parallel to the gate lines, most often connected to Vcom. The block dim problem occurs only when either the previous gate line (GLy−1) or the next gate line (GLy+1) is used as reference node for the storage capacitor (Cst). In the following, LCD-panels will be discussed where the previous gate line (GLy−1) is the reference node for the storage capacitor (Cst), but the solution presented can easily be applied to panels where the next gate line (GLy+1) is the reference node.

Different patterns can be applied to LCD-panels, but the most critical pattern is an asymmetrical pattern which generates high return current on the VL. One such pattern is the so called DoDo-pattern, which means Dot-on, Dot-off for neighbouring dots. When the LCD-panel is driven with asymmetrical patterns, the column to row parasitic capacitors present on the LCD-panel couple a large amount of charges in the gate off supply line (VL) of the gate drivers. However, the discharging of gate off supply line (VL) cannot be completed within one line time because of the large gate off supply line (VL) track resistance.

This incomplete discharge causes an error in the sampled voltage of the individual dots, since gate off supply line (VL) is coupled to the dot via the previously addressed gate line (GLy−1) and the storage capacitance (Cst). The sampled voltage error is different for each gate driver of the LCD-panel, because the gate off supply line (VL) resistance seen by every gate driver discretely sums-up. The sampled voltage error results in different grey levels on the LCD-panel. Since the difference in grey level occur step wise, exactly at the edge between gate drivers, the eye of a user detects the transition very easily and hence horizontal block-dims are perceived.

There are some known solutions to overcome the horizontal block-dim problems.

Firstly one can try to reduce the steps in the transition between the grey blocks. This is achieved by matching the gate off supply line (VL) resistance seen by the last line of one gate driver with the gate off supply line (VL) resistance seen by the first line of the next gate driver. On a given gate driver, the increase of the gate off supply line (VL) resistance from first to last output must occur gradually in order to not produce visible steps. This would require that the gate off supply line (VL) resistance on the gate driver perfectly matches with the gate off supply line (VL) track resistance on the glass and that the value of the gate driver resistance is different for every gate driver, depending on its position in the panel (first, second or third device for XGA). A different value for the gate drivers is not possible, because the gate drivers come from the same manufacturing reel. The way to minimise the steps by using gate driver VL tracks that are kind of an average value of what should be used in every gate driver still produces perceivable block-dims.

Secondly there is a method to artificially blur the position dependent error into a larger but position independent error. This is achieved by increasing the gate off supply line (VL) source resistance to such a high value that the position dependent VL track resistance steps on the glass become negligible when compared to the source resistance. As an example, if the on-glass resistance between two drivers is 25 Ω, then with a gate off supply line (VL) source resistance of 500 Ω, the relative difference in gate off supply line (VL) resistance seen by each gate driver is small, and hence the difference in sampled error also. This method will increase the absolute value of the error though to approximately the same level for all dots and hence the front-of-screen performance of the whole LCD-panel degrades for carefully selected special patterns.

The third method to avoid the above mentioned problems is to make a perfectly smooth grey level change from line to line. This can be achieved with a special dot layout, where the capacitance (Cst) is not connected to previous or next gate line, but to a separate additional line. The additional line connected to Capacitance (Cst) is usually connected to the common electrode voltage (Vcom), hence the common denomination of "Cst to Vcom" for this solution. The main advantage of this approach is that the Vcom track resistance does not change in large steps for a complete block of lines, but in small increments from line to line. Since those increments are regular and small, they can not be detected by the eye. There are however drawbacks of this solution. The aperture ratio (AR), e.g. the ratio between light transmissive and light blocking area in a dot, is reduced by the additional line. Further the additional Vcom lines of every row need to be connected by a contact to the Vcom summing line, which must be routed on a second metal to avoid crossing with the gate lines. This additional process step reduces LCD-panel yield and is more expensive.

So it is an object of the invention to avoid the block-dim effects, while keeping the effort low.

This will be achieved with the features of claim 1.

The present invention bases on the idea that a clean gate off supply line (VL) should be supplied to the storage capacitors (Cst) of the addressed gate line. It is based on the observation that only the presently addressed line needs a clean (error-less) gate off supply line (VL) connection on the reference terminal of its storage capacitors in order to sample correct values on its dots. If the storage capacitors of the addressed line are connected to previous gate line (GL), then only this previous gate line (GLy−1) needs an error-less gate off supply line (VL). If the storage capacitors are connected to next GL, then only that next gate line (GLy+1) needs an error-less gate off supply line (VL). All other (non-addressed) lines may have their storage capacitance (Cst) connected to a gate off supply line (VL) that does not completely discharge.

The implementation of the invention thus consists in a circuit that connects the storage capacitance (Cst) reference terminal (GLy−1 or GLy+1 depending on panel) of the addressed gate line GLy to a separate clean gate off supply line, which is named VLclean line hereafter. All other capacitors (Cst) remain connected to the usual VL supply line. The track resistance of VLclean line is not of big concern, since there is only one line at a time connected to it. The return current of VLclean line has ~1/n the value of the return current of gate off supply line (VL) and can thus fully discharge within one line time. As a consequence, all lines are sampled with a correct reference voltage at capacitance (Cst).

This is advantageous, because the presented invention does not require a resistance matching between LCD-panel and driver. It can thus be used for any LCD-panel resolution and is tolerant to the LCD-panel process variations. Further it does not add any additional error to the system. The discharging of all non-addressed lines is only limited by the gate off supply (VL) track resistance of the LCD-panel and not additionally by a large source resistance. Thus the artifacts introduced by incomplete discharging of non-addressed rows, like reduced viewing angle, is minimised. The proposed solution does avoid the costs and performance drawbacks of the third described method by simultaneously removing any grey level change from line to line. So it can be summarised, that the present invention smartly removes the gate off supply line (VL) induced error at the right moment in the right place. The main advantage of the proposed invention is that the horizontal block-dims induced by incomplete discharging of the gate off supply line are completely removed since all addressed lines are sampled with a capacitance (Cst) reference line of identical value. This results in a uniform and correct sampled dot voltage for all rows of the LCD-panel, regardless of their position and to which driver they are connected. A small drawback of the solution is that it requires an additional track to all gate drivers of the LCD-panel.

Figure 2:
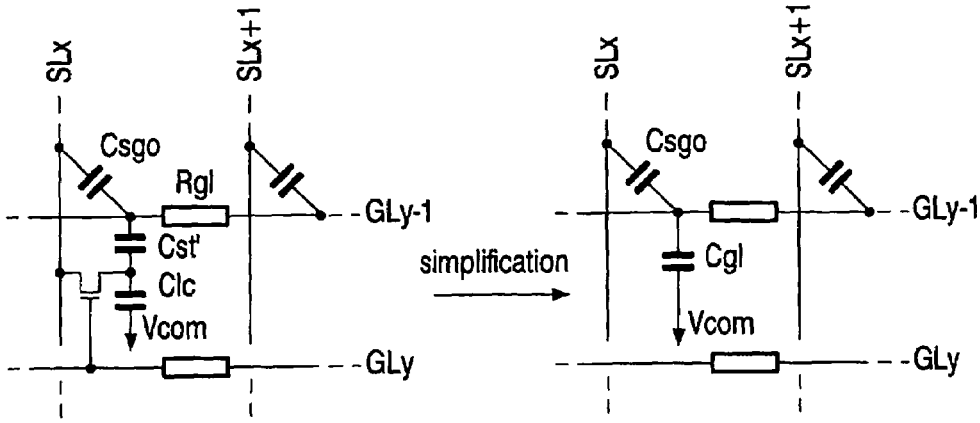

In order that the invention may be well understood, there will now be described some embodiments thereof, given by way of example, references being made to the accompanying drawings, in which:

FIG. 1: schematic XGA-LCD-panel with supply track resistance known from the prior art FIG. 2: TFT-LCD dot model FIG. 3: block-dim effect on XGA LCD-panel FIG. 4: gamma curve for 6 bit resolution FIG. 5*a*: schematic diagram for capacitive coupling from source lines into gate lines FIG. 5*b*: simplification of the capacitive coupling from source lines into gate lines of FIG. 5*a*

Figure 6:
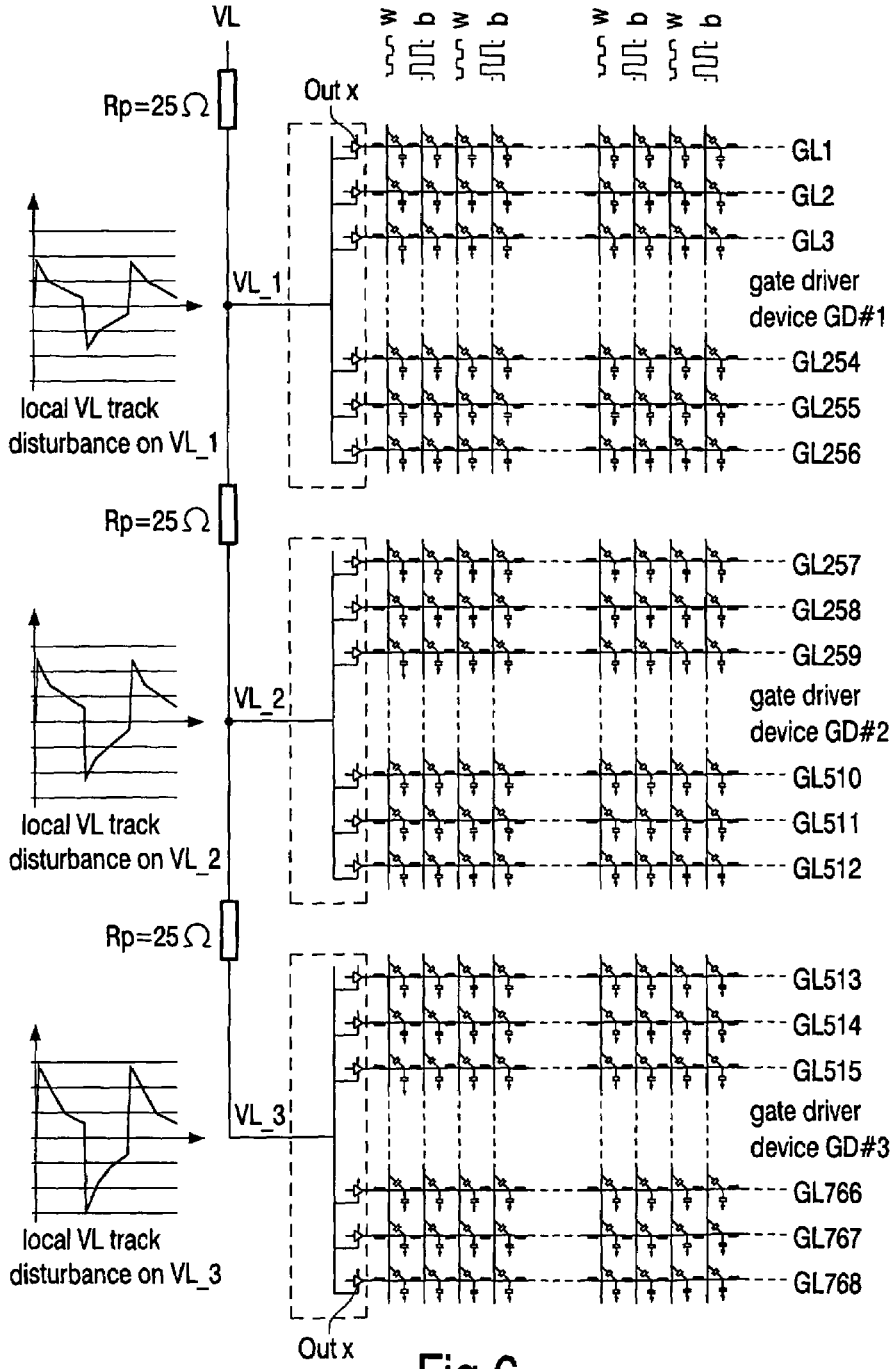
Figure 7:
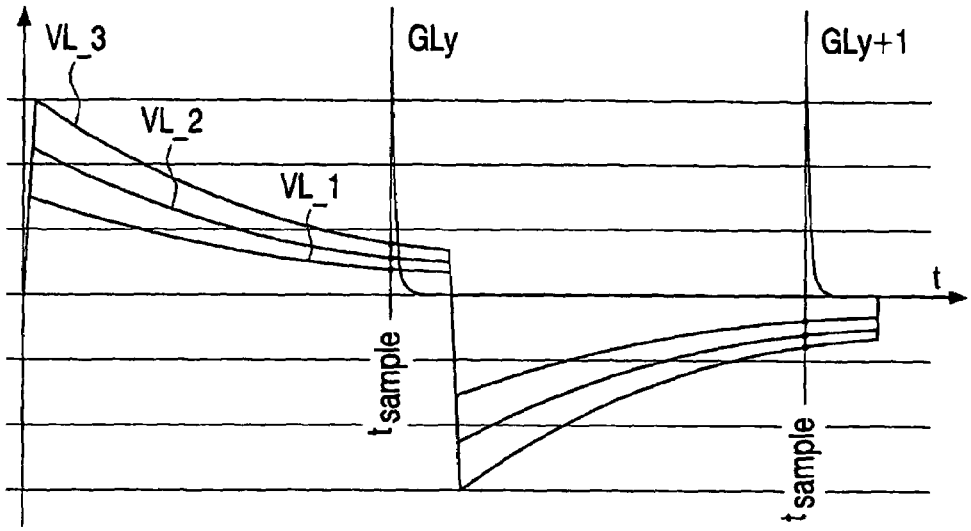

FIG. 6: schematic XGA LCD panel with VL track disturbances due to DODO pattern FIG. 7: Waveform of VL track disturbance at sampling time of pixel voltage FIG. 8: sampling of dot voltage FIG. 9: XGA-LCD-panel with VL track disturbances due to gate line GLy discharge FIG. 10: LCD-panel with additional supply track Vlclean FIG. 11*a*: state of the art output stage FIG. 11*b*: output stage with additional supply line VLclean FIG. 12: timing diagram of the proposed output stage In the following figures, the same references numerals will be used to identify identical components in the various views.

FIG. 1 shows a full XGA LCD-panel with 3 gate drivers GD1-GD3 as found on a PCB-less or COG assembly known from the prior art without the implementation of the present invention. All supplies and control signals (VH, VL, VDD, GND, CLK, DIS, Start) are routed from one LCD-panel corner to the gate drivers GD1-GD3 on the active plate of TFT LCD-panel. As a consequence, the track resistance seen by gate driver GD3 is about 3 times higher than one seen by gate driver GD1.

FIG. 2 shows the model of a TFT-LCD dot. In this configuration the storage capacitor Cst of a gate line GLy is connected to the previous gate line GLy−1, but the model can be used for the configuration with Cst connected to the next line GLy+1 as well. Most of today's LCD-panels use a capacitor Cst connected to previous line GLy−1. Such a dot layout is widely used because it avoids the use of an additional Vcom line per row, which would negatively affect light transmission, viewing angle, fabrication yield, cost etc.

The capacitor Clc is the capacitor of the liquid crystal cell. Cst' is a simplification of the storage capacitor Cst in parallel with Cc, which is the overlap capacitance between Gly−1 and dot. Capacitor Csgo is the overlap capacitance between source line SLx and gate line GLy. Rg1 is the gate line resistance per dot. Examples of typical values are: Clc=250 fF, Cst=175 fF, Cc=18 fF->Cst'=193 fF, Csgo=19 fF, Rg1=1Ω, Cg1=109 fF.

Figure 3:
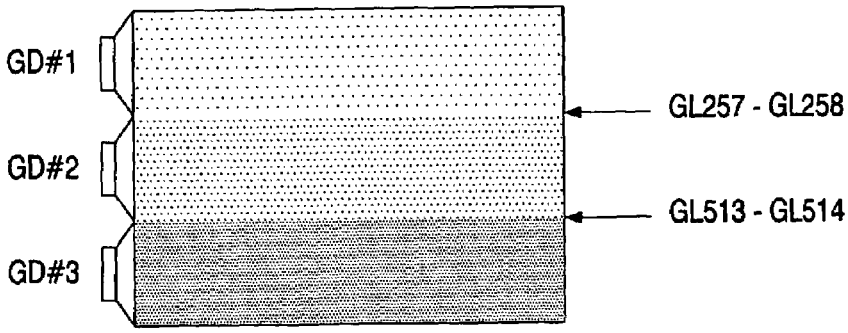
Figure 4:
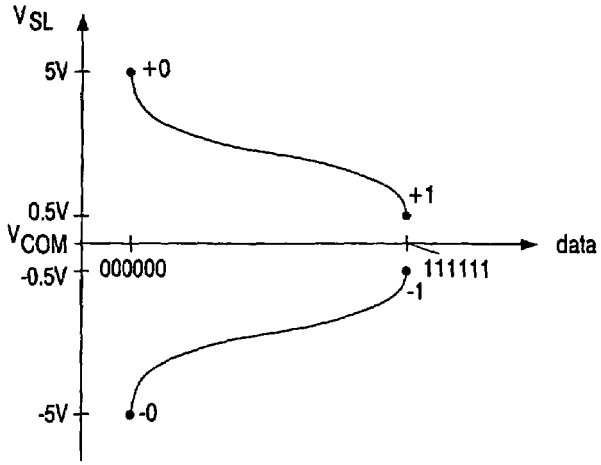

FIG. 3 shows the block dim effect on a XGA LCD-panel. The most critical block dim occurs in conjunction with a special asymmetrical pattern referred to as 'DODO' pattern. The DODO pattern displays for example white-black-white-black-white-black etc. values in consecutive columns.

The following table shows the brightness of the dots as 1 (for white) or 0 (for black) and the polarity + and − with respect to Vcom of the applied voltage (upper or lower gamma curve). This asymmetric pattern induces large return current on the VL supply due to capacitive coupling from column to rows. This large return current produces a significant disturbance on the local VL supplies of the individual gate drivers. Due to the finite impedance of the VL tracks, the disturbances of the local VL's cannot attenuate sufficiently within one line time. Since VL is used as reference in every dot (connected to Cst), different VL levels for every gate driver produces different grey values, which results in a block dim effect showed in FIG. 3.

through the output stage (OUTx) of the gate drivers (GD1-GD3) to the local VL's (VL_1, VL_2, VL_3 etc.) of the corresponding gate driver. The discharge current passes through the resistors Rp of the VL LCD-panel-track.

The total gate line capacitance for an XGA LCD-panel is typically 257 nF (=768-lines*3072-columns*109 fF/gate line) and the mean LCD-panel track resistance 50Ω (2*25 Ω (mean value is from the VL supply to the middle gate driver device). The resulting RC time constant for the discharge process is thus 12.9 ms (50 Ω * 257 nF), which is very close to the XGA row time of about 20 ms. This means that the discharge process cannot be finished within one row time, since typically 6 tau are required to discharge VL within the accuracy of a 6-bit LCD-panel.

The voltage on the local VL's shows the same discharge curve as the current that flows trough the individual resistance Rp. Thus, the discharge amplitude and waveform is much different for VL_1, VL_2 or VL_3, since the impedance towards the VL supply is position dependent (number of series-connected Rp's).

| | Red | Green | Blue | Red | Green | Blue | Red | Green | Blue . . . |
|---|---|---|---|---|---|---|---|---|---|
| Row1 | 1+ | 0− | 1+ | 0− | 1+ | 0− | 1+ | 0− | 1+. . . . . |
| Row2 | 1− | 0+ | 1− | 0+ | 1− | 0+ | 1− | 0+ | 1−. . . . . |
| Row3 | 1+ | 0− | 1+ | 0− | 1+ | 0− | 1+ | 0− | 1+. . . . . |
| Row4 | 1− | 0+ | 1− | 0+ | 1− | 0+ | 1− | 0+ | 1−. . . . . |
| Row5 | 1+ | 0− | 1+ | 0− | 1+ | 0− | 1+ | 0− | 1+. . . . . |
| Row6 | 1− | 0+ | 1− | 0+ | 1− | 0+ | 1− | 0+ | 1−. . . . . |

With the DODO pattern, all odd columns are white and all even columns are black. The first pixel, which includes 3 dots, of row 1 will display red and blue dots (magenta), the second pixel will display green. The DODO pattern is perceived as grey by the eye, since the optical average of magenta and green is grey. Because of the chosen inversion scheme, the polarities of the applied signal changes for every column and every row (dot by dot).

As the table shows, half the dots of first row are 1+ and the other half is 0−. For Row2 half the dots are 1− and the other half is 0+. The voltage level corresponding to '0' and '1' is determined by the gamma curve, as shown in the FIG. 4:

If for example '1'=Vcom+/−0.5V and '0'=Vcom−/+5.0V, the average column voltage is Vcom=+2.25V for Row1 and Vcom=−2.25V for Row2. Therefore, the average column voltage is jumping by 4.5V at every line time. This is why the DODO pattern is called an asymmetrical pattern.

Figures 5A, 5B:
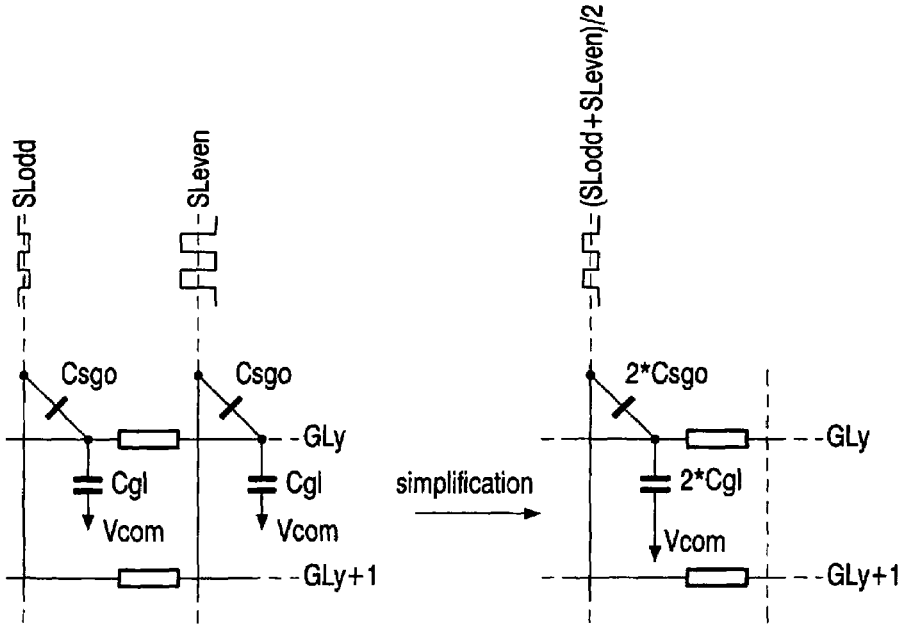

FIG. 5*a* shows the schematic diagram of the capacitive coupling from source lines SL into gate lines GL. Due to the column to row overlap capacitance Csgo in every dot, this 4.5V jump of the average column voltage is capacitively coupled into all the gate lines Gly of the LCD-panel. The capacitance Cg1 is the simplification of the capacitors Cst' and Clc, as described in FIG. 2. The ratio between the capacitor Csgo and capacitor Cg1 is roughly 1:5. This means that about ⅙ of the amplitude of the pulse present on the source lines is coupled into the gate lines GL. Looking at a pair of TFT-LC cells, source line SLodd and source line SLeven can be replaced by the average (SLodd+SLeven)/2, which is represented in FIG. 5*b*. So the capacitive coupled voltage into the gate lines will be in this example 4.5V/6=750 mV. Note that the pulses SLodd and SLeven are out of phase because the polarity of the applied voltage is opposite for two adjacent columns, due to the dot inversion drive scheme.

FIG. 6 shows a schematic XGA LCD panel with VL track disturbances due to DODO pattern. The charge brought onto the gate lines GL by capacitive coupling then discharges FIG. 7 shows an XGA LCD-panel with the local waveforms on VL_1, VL_2 and VL_3 when the DODO pattern is applied to the columns. It clearly highlights that the disturbance on VL_1, VL_2 and VL_3 significantly differ at the sampling point $t_{sample}$, when the active gate line GLy goes low.

Figure 8:
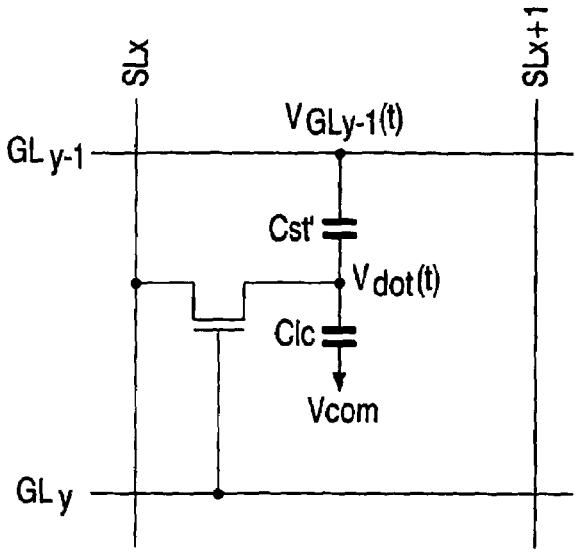

FIG. 8 shows a sampling of dot voltage. At the sampling point tsample, the voltage at the source line SLx is sampled on the dot. A voltage V.sub.GLy−1 different from the ideal VL value results in an extra charge on the dot, which is preserved on the capacitors Cst' and Clc, once the TFT transistor is off. Since the mean voltage on GLy−1 is VL, the mean voltage on the dot cell gets an offset voltage of ΔVdot=−(VLy−1 ($t_{sample}$)−VL)*Cst'/(Cst'+Clc).

Since Cst and Clc are about the same, the mean dot voltage has an offset (error) of approximately half the voltage $VL_{y-1}$-VL at the sampling moment. Because the disturbance on $V_{GLy-1}$ is equal to the disturbance of the local VL_1 to VL_3 lines at the input of the gate drivers, the error in the dots depends on the local VL disturbance. Because the VL track resistance increases in finite steps from gate driver to gate driver, the dot error voltage ΔVdot also makes a step at the boundary between two gate drivers. This step in the error function can be detected by the eye and is showed in FIG. 3. The visible result is a horizontal block-dim with grey shades of different intensity and with edges corresponding to the boundary of every gate driver device.

There is another effect which results in a block-dim. The second block-dim effect can occur with any pattern. It is not as strong as first block-dim effect and can usually not be detected by human eye. Careless supply routing of VL on the LCD-panel, on chip or generally large VL track resistance can however bring this effect to detectable levels. The second cause for the disturbances on VL is the discharge current of gate line GLy, when the gate driver switches to the 'OFF' state (VL). The charge of GLy discharges through the output stage into the local VL_x supply of the corresponding gate driver and then through the VL track resistance Rp to the VL supply. At the first time after the switching of GLy, a significant part of the charge is locally distributed over all other gate lines of the same driver, e.g. the capacitance of all unselected gate lines acts as a VL decoupling capacitor. This local VL decoupling reduces the amplitude of the disturbance on the local VL_x by a large amount. The unselected lines of the adjacent gate drivers also act as local decoupling capacitances, reducing the amplitude of the disturbance further.

Figure 9:
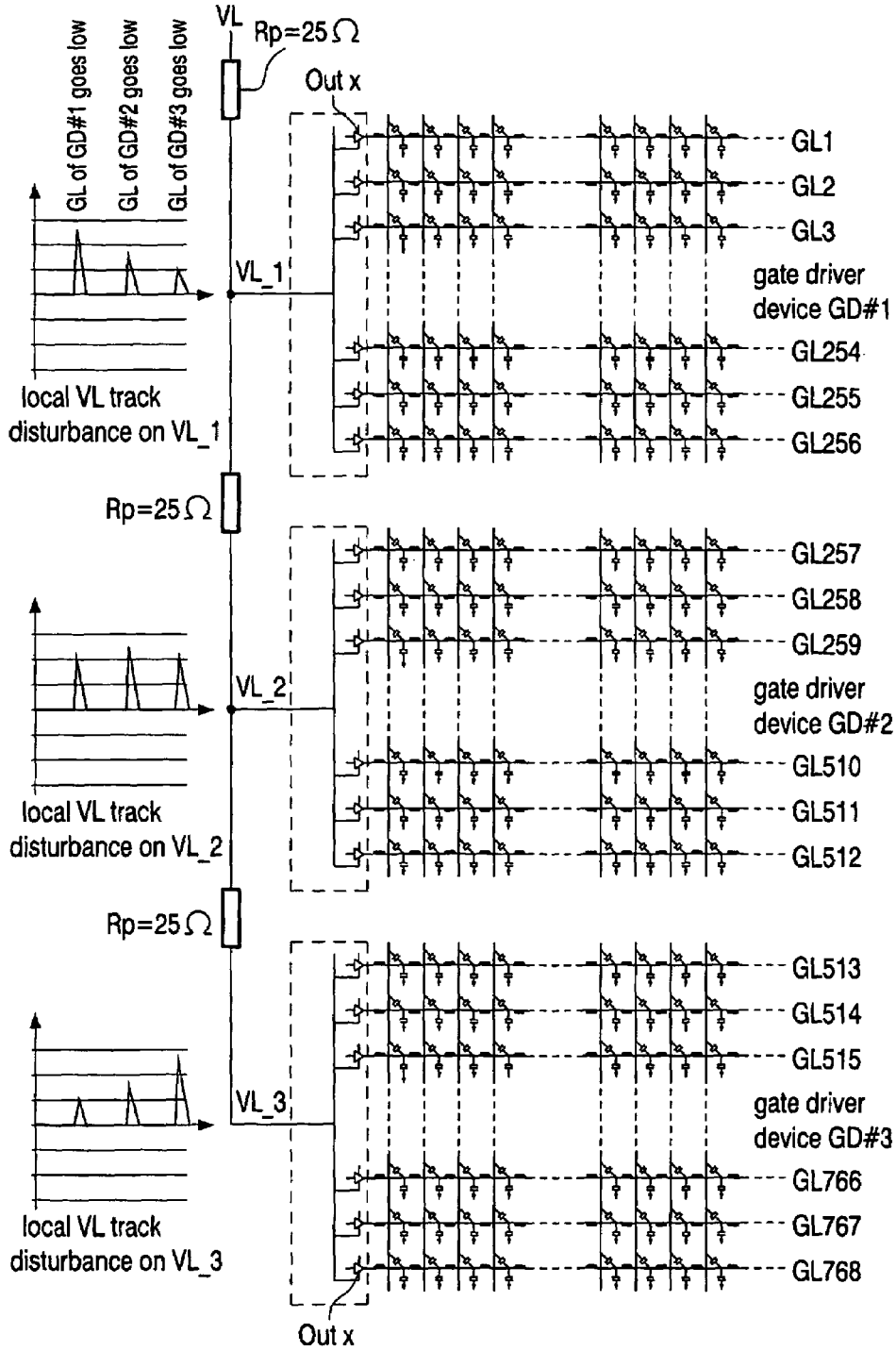

FIG. 9 shows 3 pulses for each local VL_x. The first pulse shows the local disturbance when any GL driven from device gate driver GD1 is going low. The second pulse is the local disturbance when a GL from gate driver GD2 switches and the third pulse happens when a GL from gate driver GD3 switches. The disturbance or spike on VL happens exactly at the sampling moment. Because the TFT is rapidly closing, only a small part of the error $V_{GL\ y-1}$ ($t_{sample}$)−VL will be injected into the dot. It would however be possible that in some applications this can lead to a visible dim.

Figure 10:
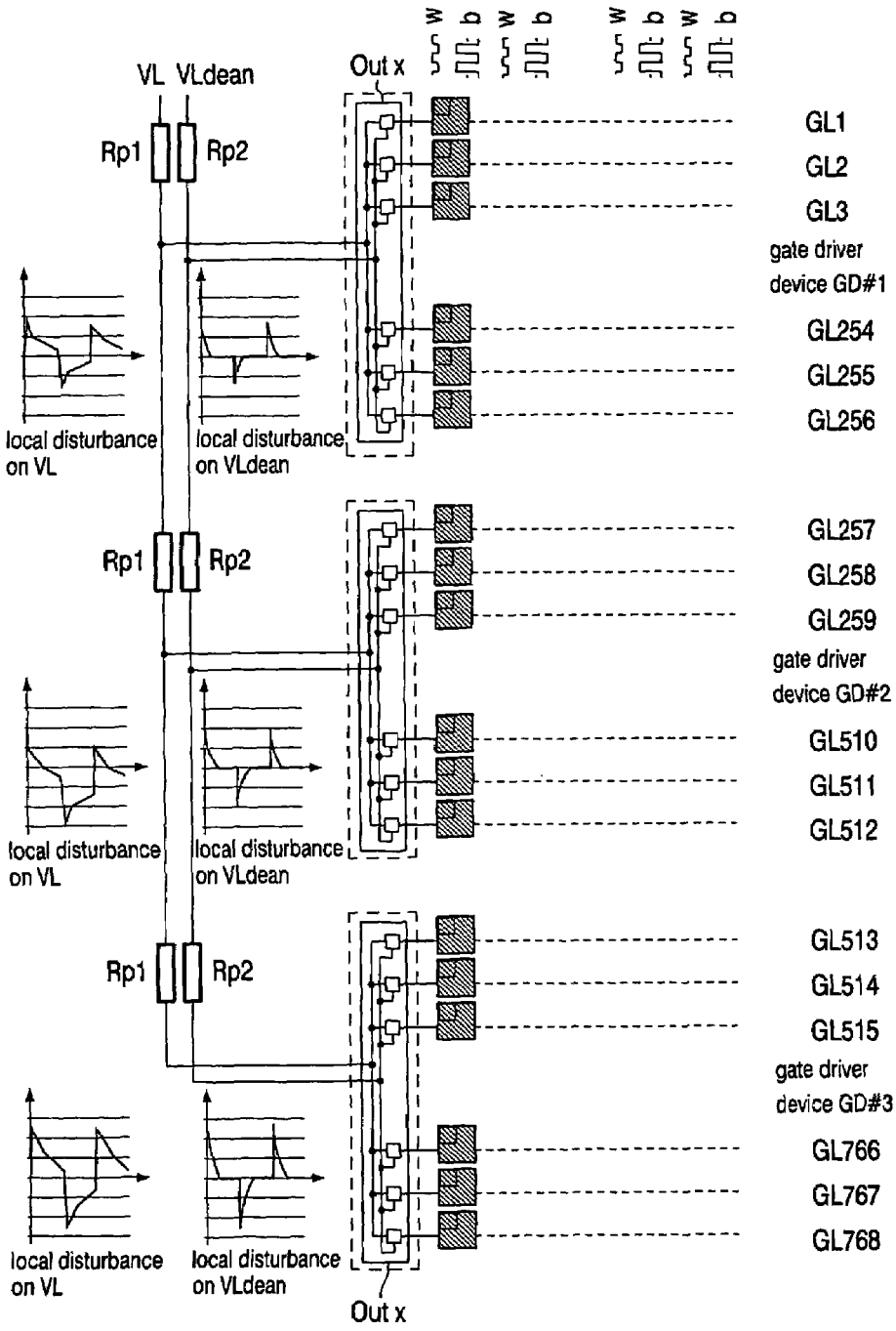

FIG. 10 shows a LCD-panel with additional supply track VLclean, wherein the gate drivers GD I-GD3 are illustrated schematically. The main problem with the DODO pattern is that the local supplies of the gate driver devices (VL_1, VL_2, VL_3, etc.) do not recover fast enough from the coupling of the source lines. The time constant is much too long due to the large LCD-panel resistance and the large sum of the LCD-panel gate line capacitance. This time constant can practically not be reduced. However, the VL error voltage has only a detrimental effect to the storage capacitors of the addressed line of the LCD-panel at sampling point. Whether the non-addressed lines have their capacitor Cst reference voltage jumping around from line to line is only of second importance, since it does not alter the sampling operation of the dots. The present invention is based on this singular observation: only the presently addressed line needs a clean or errorless VL line connected to capacitor Cst in order to store the correct dot voltage at sampling point.

By adding an extra supply line on the LCD-panel which is used exclusively for discharging of the gate line GLy−1 (in the case where Cst is connected to previous GL) the pulse coupled into gate line GLy−1 by the source lines can be attenuated a lot faster, since the capacitance that needs to be discharged is only 1/768 (for an XGA panel) or 1/1024 (for an SXGA panel) of the total LCD-panel capacitance. As a consequence the LCD-panel track resistance Rp2 of the VLclean supply track can be considerably higher than the LCD-panel track resistance Rp1 of VL. The same principle can be applied to a LCD-panel that has Cst connected to next gate line GL by connecting VLclean to gate line GLy+1.

Figure 11A:
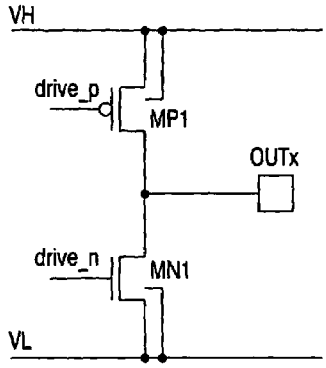

FIG. 11*a* shows the output stage architecture of a traditional 2-level gate driver. In a traditional gate driver, the PMOS transistor MP1 is conducting when the gate line is selected. NMOS transistor MN1 is conducting when the line is unselected.

Figure 11B:
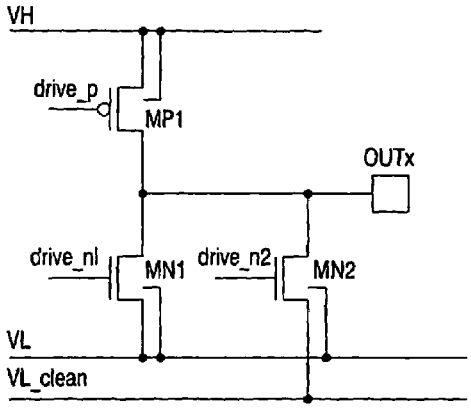
Figure 12:
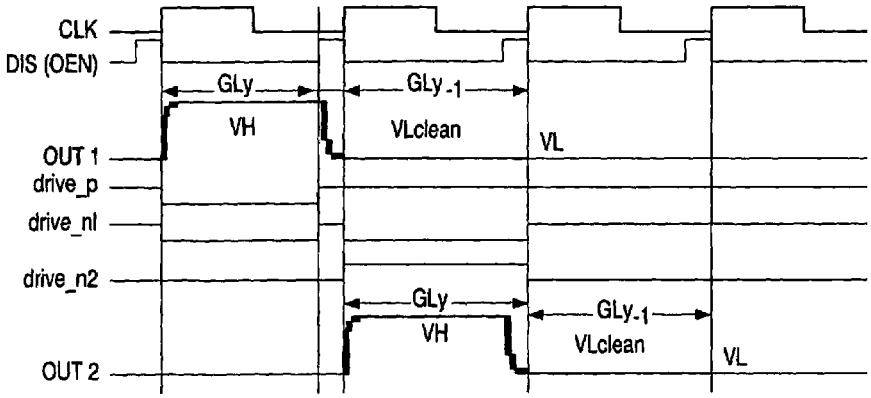

FIG. 11*b* shows the output stage architecture of a gate driver with 2 gates off VL supplies. Instead of one PMOS MP1 and one NMOS transistor MN1, there is one PMOS MP1 and 2 NMOS (MN1 and MN2) for the gate driver with additional VLclean line. In the output stage with additional VLclean line, the timing for MP1 remains the same as with traditional gate drivers. MN1 and MN2 are however driven slightly different. As depicted in FIG. 12, MN2 is conducting during the whole phase GLy−1, so the gate line GLy−1 is connected to VLclean line when gate line GLy is selected. MN1 is conducting in all other unselected phases, so all other gate lines are connected to VL. Note that it is recommended to turn-on MN1 already at the end of phase GLy when OUTx switches from VH to VL. This transition, which determines the sampling point (tsample) is usually induced by activating signal DIS ("disable") or EON ("output enable not").

The invention claimed is:

1. A LC-Display with n gate driver and source drivers for driving the LC-Display with dots arranged in x rows and y columns, wherein the gate drivers comprise several output stages for driving the gate lines of the LC-Display, the LC-Display comprising:

a gate on supply line VH to turn on a transistor of the LC-Display;

a gate off supply line VL to turn off a transistor of the LC-Display, wherein the gate off supply line VL;

an additional gate off supply line VLclean to substantially reduce a discharge time associated with driving transistors of the LC-Display, wherein the additional gate off supply line is coupled to the output stages of the gate drivers and is routed as a separate track from the gate off supply line VL; and a circuit to connect a storage capacitance Cst of a selected gate line GLy to the additional gate off supply line VLclean and to keep other storage capacitors Cst of unselected gate lines connected to the gate off supply line VL.

2. The LC-Display as claimed in claim 1, wherein the output stage comprises:

a PMOS transistor MP1 arranged between the gate on supply line VH and an output of the output stage;

a first NMOS transistor MN1 arranged between the gate off supply line VL and the output of the output stage; and a second NMOS transistor MN2 arranged between the additional gate off supply line VLclean and the output of the output stage.

3. The LC-Display as claimed in claim 1, wherein the additional gate off supply line VLclean is routed over a separate track on the LC-Display glass.

4. The LC-Display as claimed in claim 1, wherein a track of the gate off supply line VL and a track of the additional supply line VLclean are coupled to a same supply level.

5. The LC-Display as claimed in claim 1, further comprising a power supply to supply a voltage to the gate off supply line VL and the additional gate off supply line VLclean, wherein a track of the gate off supply line VL and a track of the additional gate off supply line VLclean are connected together in a location where a track impedance to an output of the power supply is relatively low.

6. A method for driving a display with n gate drivers and at least one source driver, the method comprising:

arranging dots in x rows and y columns;

providing several output stages for driving gate lines of the display;

providing a gate on supply line VH to turn on a transistor of the LC-Display;

providing a gate off supply line VL to turn off a transistor of the LC-Display;

providing an additional gate off supply line VLclean to substantially reduce a discharge time associated with driving transistors of the LC-Display, wherein the additional gate off supply line is coupled to the output stages of the gate drivers and is routed as a separate track from the gate off supply line VL;

connecting a capacitance of a selected gate line to a previous gate line; and activating an additional supply line VLclean of the output stage for the selected gate line with the supply line VL when the previous gate line is activated.

7. A method for driving a display with n gate drivers and a source driver, the method comprising:

arranging dots in x rows and y columns;

providing several output stages for driving gate lines of the display;

providing a gate on supply line VH to turn on a transistor of the LC-Display;

providing a gate off supply line VL to turn off a transistor of the LC-Display;

providing an additional gate off supply line VLclean to substantially reduce a discharge time associated with driving transistors of the LC-Display, wherein the additional gate off supply line is coupled to the output stages of the gate drivers and is routed as a separate track from the gate off supply line VL;

connecting a capacitance of a selected gate line to a next gate line; and activating an additional supply line VLclean of the output stage for the selected gate line with the supply line VL when the next gate line is activated.

* * * * *